US006329028B1

(12) United States Patent
Bucher

(10) Patent No.: US 6,329,028 B1
(45) Date of Patent: Dec. 11, 2001

(54) "AUTUMN TREE" AN INDOOR/OUTDOOR ARTIFICIAL TREE

(76) Inventor: Bobby J. Bucher, 480 Gold Meadow, Terrell, TX (US) 75061

( * ) Notice: Subject to any disclaimer, the term of this patent is extended or adjusted under 35 U.S.C. 154(b) by 0 days.

(21) Appl. No.: 09/758,984

(22) Filed: Jan. 16, 2001

(51) Int. Cl.[7] ..... A01N 3/100

(52) U.S. Cl. ..... 428/18; 428/17; 428/19; 428/22; 428/27; 428/68; 362/123; 362/806; 211/205

(58) Field of Search ..... 428/18, 32, 20, 428/19, 8, 17, 22, 27, 68; 362/123, 249, 806; 211/205; D11/118

(56) References Cited

U.S. PATENT DOCUMENTS 4,573,102 * 2/1986 Norwood ..... 362/123
5,486,386 * 1/1996 Rovesk ..... 428/18
6,117,503 * 12/2000 Lee et al. ..... 428/16

* cited by examiner

*Primary Examiner*—Deborah Jones
*Assistant Examiner*—Abraham Bahta

(57) ABSTRACT

The present invention is a unique design and technique of construction for an artificial tree. The tree is created from an engineered superstructure with a porous outer covering or skin. Artificial leaves are attached to the skin creating an artificial tree with no limbs or branches. An additional feature is a light source that can be incorporated inside the superstructure to illuminate the tree. The foliage is replaceable to allow for seasonal color changes.

1 Claim, 4 Drawing Sheets

11
Top
12
Front
10
13
Isometric

"AUTUMN TREE" AN INDOOR/OUTDOOR ARTIFICIAL TREE

FIELD OF THE INVENTION

This invention is a unique design and technique of construction in the field of artificial botanicals. More specifically, it is an artificial tree fully covered with foliage without limbs or branches. Additionally, this invention makes it possible to internally illuminate the tree.

BACKGROUND OF THE INVENTION

Artificial trees are produced and sold in an endless variety of shapes, sizes and colors. Many materials both natural and man made are used for the trunk, limbs and foliage. One characteristic that all existing designs share is the use of limbs or branches to which foliage is attached. Another characteristic is that illumination of existing designs can only by accomplished by external lights shining on them. Although lights of some form may be attached to the external surfaces of existing artificial trees none of them can be illuminated from within.

It is therefore, the object of this invention to create a fill foliage artificial tree that has no limbs or branches and can be illuminated internally.

SUMMARY OF THE INVENTION

This invention incorporates an engineered superstructure with a porous skin for attachment of foliage. There are no limbs or branches used to create this artificial tree. The design of the superstructure creates a "skeleton" or shell for the tree. A porous skin is then attached to the shell. The porous skin creates an attachment point for individual leaves or foliage. Once the skin has been applied to the superstructure, a cavity or void is created for the inside of the tree. By design, this void provides a place for lighting fixtures to create internal illumination of the tree. The porosity of the skin allows light to be emitted through it. As a result, the light emitted through the porous skin illuminates the semi-translucent foliage. This illumination results in the tree appearing to "glow" from within. Additionally, by design, some light emitted through the porous skin passes between the individual leaves and contacts surrounding objects and of structures. A second intent of the porous skin allows for the foliage to be replaceable. Thus, this tree can change colors with the seasons if desired.

BRIEF DESCRIPTION OF THE DRAWINGS

Other features and advantages of this invention will become apparent from the detailed description of the invention that follows, when considered in light of the accompanying drawings in which.

DETAILED DESCRIPTION OF THE PREFERRED EMBODIMENTS

The present invention will now be described more fully with reference to the accompanying drawings, in which preferred embodiments of the invention are shown. These embodiments are provided so that this disclosure will be thorough and complete, and will fully convey the scope of the invention. They are not intended to limit the scope of the invention.

Figure 1:
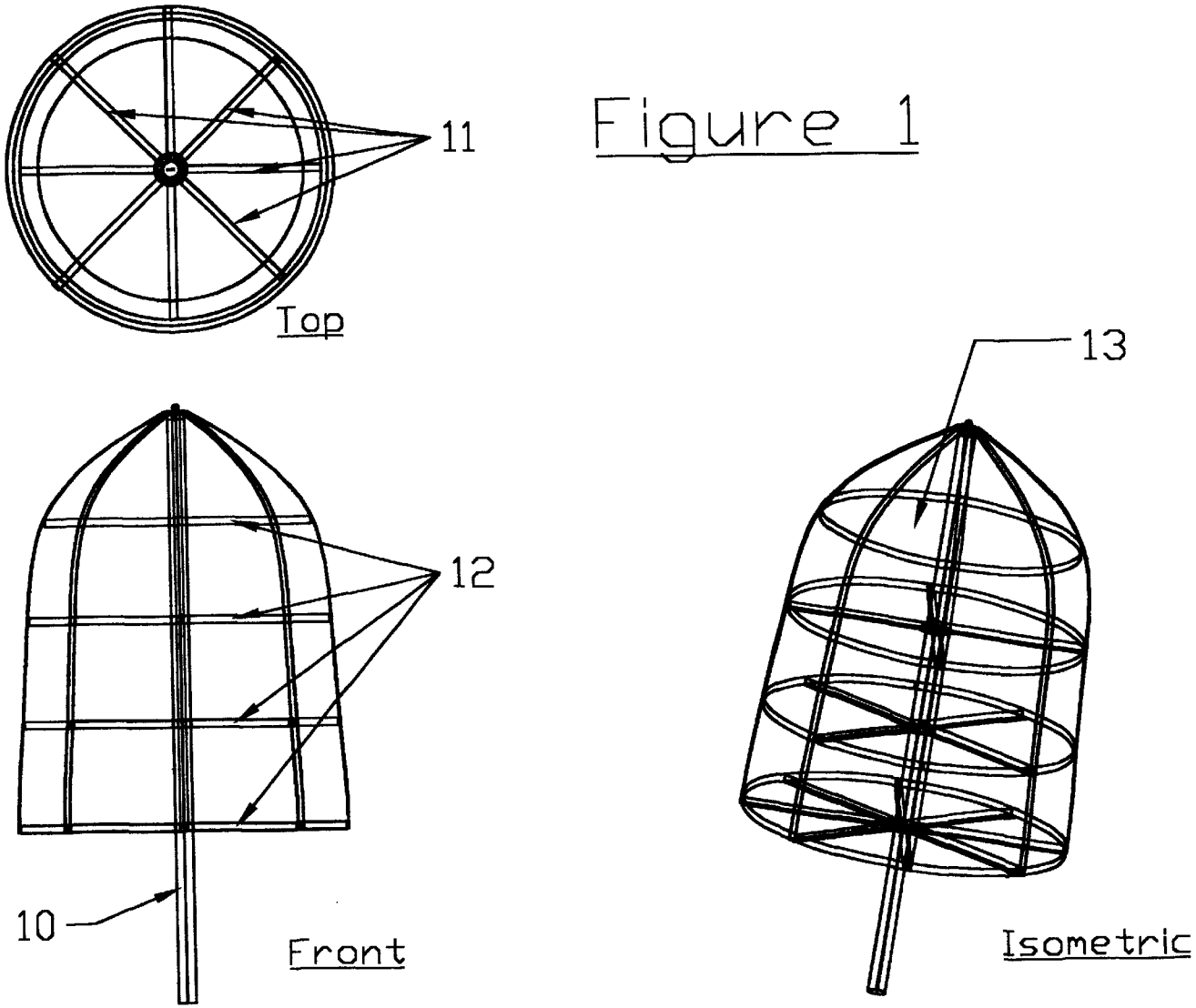
FIG. 1 is a drawing of the internal superstructure of the tree

Referring now to FIG. 1, one can view the superstructure assembly for the "Autumn Tree". The assembly consists of a center support column (10) to which structural supports (11) are attached. Perimeter bands (12) are then attached to the supports (11). The use of these traditional mechanical-engineering techniques allows the internal cavity (13) for the tree to be created. It is not the engineering that is unique, rather the concept of an artificial tree with a hollow superstructure eliminating the use of traditional limbs and branches. The internal cavity (13) allows a light source to be placed inside the tree.

Figure 2:
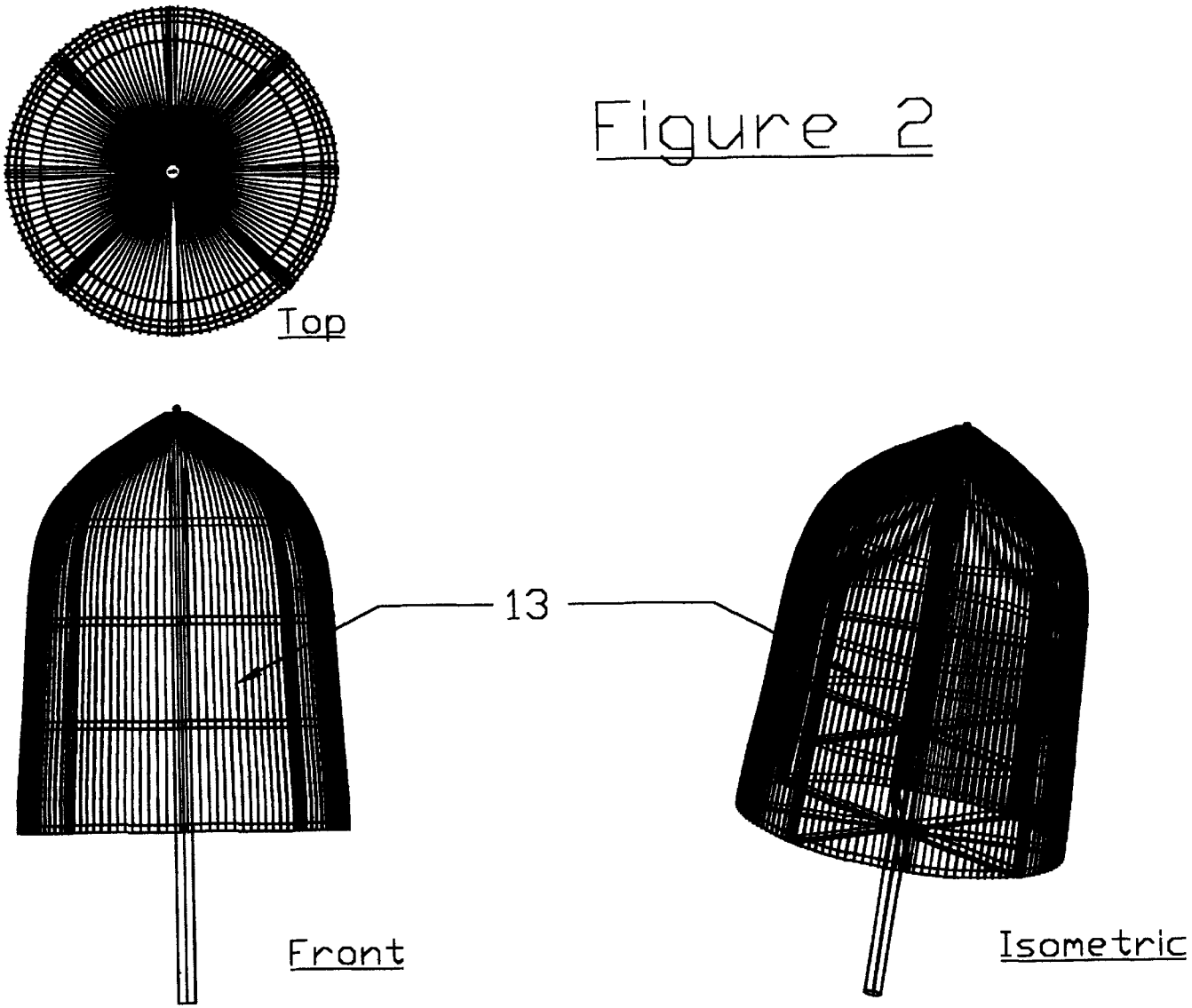
FIG. 2 is a drawing of the tree after the skin has been applied

Referring now to FIG. 2, one can view the porous skin (13) that is applied to the superstructure. The porous external skin provides two preferred embodiments for the design of an artificial tree. 1) The porosity provides attachment of foliage by inserting the stem of the foliage through the skin. 2) The porosity of the skin allows light to pass through the skin.

Figure 3:
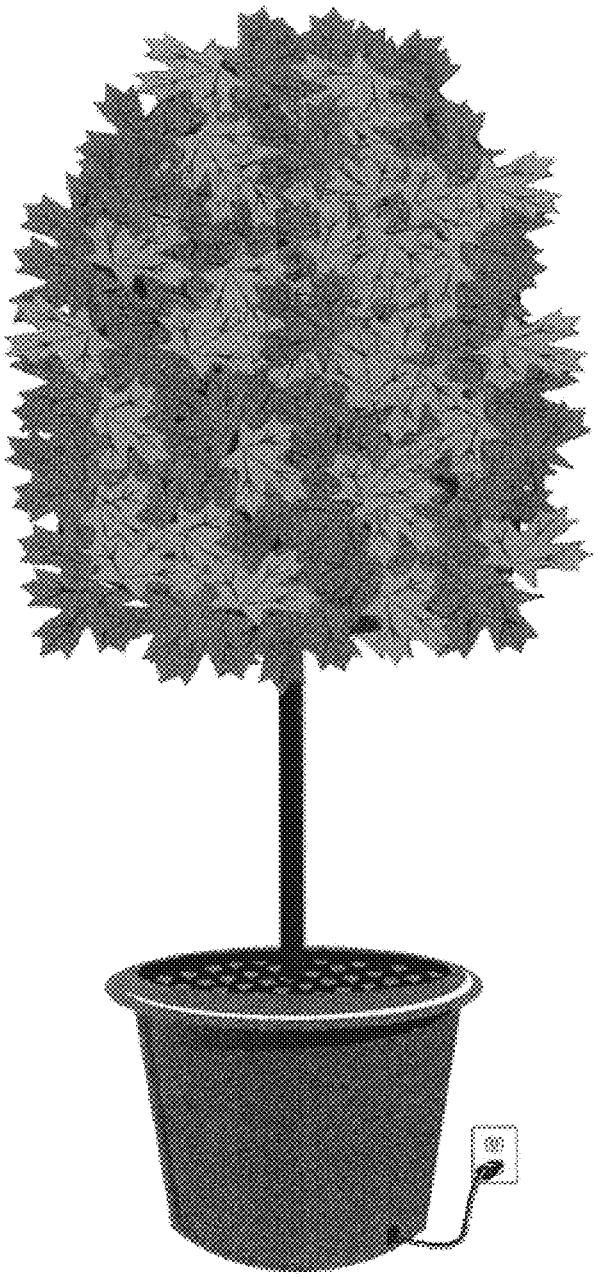
FIG. 3 is a drawing of the tree after the foliage has been applied

Referring now to FIG. 3, one can view the foliage attached to the external skin. The artificial tree is thus created without the use of limbs or branches and with an internal cavity capable of illuminating the tree from within.

Figure 4:
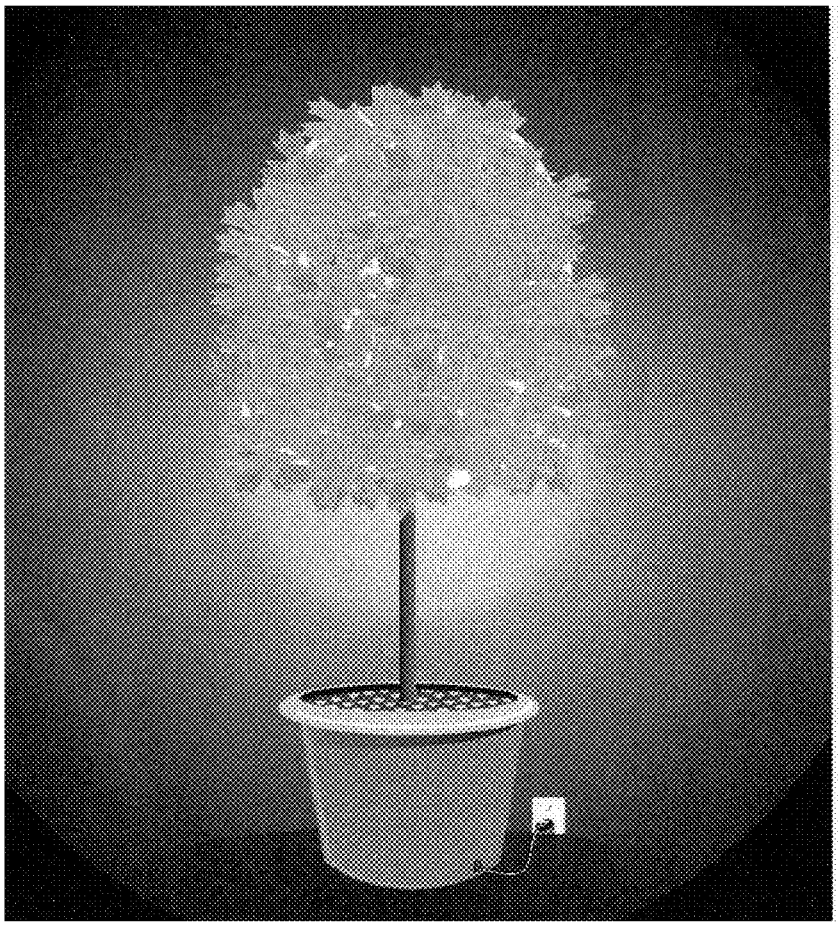
FIG. 4 is a drawing that depicts the illuminated tree.

Referring now to FIG. 4, one can view the illuminated tree. The light that passes through the skin can:

1) Illuminate the semi-translucent foliage and
2) Pass between the leaves and project onto surrounding objects or structures.

What is claimed is:

1. An artificial tree having no limbs or branches comprising:

a) a superstructure comprising a center support column, a structural support and perimeter bands wherein said structural support is attached to the support column and said perimeter bands are attached to the structural support:

b) a porous skin, said porous skin applied on top of the superstructure whereby an internal void or space is formed and wherein replaceable leaves or foliage are inserted into said porous skin: and c) a light source placed inside the cavity or void so that the artificial tree is illuminated.

* * * * *